United States Patent [19]

Morawietz et al.

[11] Patent Number: 4,968,415

[45] Date of Patent: Nov. 6, 1990

[54] PROCESS FOR SELECTIVE FLOTATION OF PHOSPHORUS MINERALS

[75] Inventors: Hans-Joachim Morawietz, Kelkheim; Werner Ritschel, Königstein/Taunas; Kurt Bauer, Kelsterbach, all of Fed. Rep. of Germany

[73] Assignee: Hoechst Aktiengesellschaft, Frankfurt am Main, Fed. Rep. of Germany

[21] Appl. No.: 462,834

[22] Filed: Jan. 10, 1990

[30] Foreign Application Priority Data

Jan. 13, 1989 [DE] Fed. Rep. of Germany ..... 3900827

[51] Int. Cl.[5] ..... B03D 1/01; B03D 1/02

[52] U.S. Cl. ..... 209/166; 252/61; 209/902

[58] Field of Search ..... 209/166, 167, 902; 252/61

[56] References Cited

U.S. PATENT DOCUMENTS

| | | | |
|---|---|---|---|
| 2,099,120 | 11/1937 | Kirby et al. | 209/166 |
| 3,779,380 | 12/1973 | Bishop | 209/166 |
| 4,309,282 | 1/1982 | Smith | 209/166 |

FOREIGN PATENT DOCUMENTS

| | | | |
|---|---|---|---|
| 862990 | 9/1978 | U.S.S.R. | 209/166 |
| 749434 | 7/1980 | U.S.S.R. | 209/166 |
| 1084076 | 4/1984 | U.S.S.R. | 209/166 |

OTHER PUBLICATIONS

Chem. Abstract, vol. 106, Abstract 104652n, "Alkyl-(Alkenyl) Succinic Acid Alkyl Monoesters-Effective Collectors for the Flotation of Apatite"-1987.

*Primary Examiner*—David L. Lacey
*Assistant Examiner*—Thomas M. Lithgow

[57] ABSTRACT

A process for selective flotation of phosphate minerals, wherein a compound of the formula 1a or 1b in which $R^1$ is branched or unbranched $C_8$-$C_{24}$-alkenyl, $R^2$ is branched or unbranched $C_1$-$C_4$-alkyl and M is hydrogen, ammonium, triethanolammonium, an alkali metal atom or an alkaline earth metal atom, is added as a collecting agent to the flotation suspension.

10 Claims, No Drawings

PROCESS FOR SELECTIVE FLOTATION OF PHOSPHORUS MINERALS

This invention relates to the separation of phosphorus minerals such as apatite, phosphorite, francolite and the like by means of flotation from crude ores or preconcentrates with the aid of anionic oxhydril collecting agents belonging to the group of the monoalkyl alkenyl succinates.

According to Winnacker and Küchler: Chemische Technologie [Chemical Technology], volume 4 (Metalle [Metals]), 4th edition, Carl Hanser Verlag Munich Vienna, 1986, page 66, collecting agents are organic-chemical compounds which, in addition to one or more non-polar hydrocarbon radicals, carry one or more chemically active polar groups which are capable of being adsorbed on active centers of the mineral and thus rendering the latter hydrophobic.

As is known, flotation (dressing by froth flotation) is a widely used sorting process for mineral raw materials, in which one or more valuable minerals are separated from the worthless ones. The preparation of the mineral raw material for flotation is carried out by dry, but preferably wet grinding of the precomminuted ore to a suitable particle size which depends, on the one hand, on the degree of intergrowth, i.e. on the size of the individual particles in a mineral assemblage, and on the other hand also on the maximum particle size which is still to be floated and which can differ widely depending on the mineral. The type of flotation machine used also has an influence on the maximum particle size which is still to be floated. Though not the rule, it is frequently the case that the well crystallized magmatic phosphate ores allow coarser grinding (for example $<0.25$ mm) than those of marine-sedimentary origin (for example $<0.15$ mm). Further steps in preparing phosphate ore for flotation can represent a preseparation of worthless material on the one hand, for example by a heavy medium separation (separating off relatively coarse constituents), and on the other hand deslurrying (separating off slurries of the finest particles). The removal of magnetic minerals, which are almost always present in phosphate ores of magmatic origin, by means of magnetic separation is also a possible preconcentrating method. The invention is not restricted, however, to flotation processes preceded by any preconcentration.

With respect to the minerals to be recovered in the froth, two procedures must be distinguished. In direct flotation, the valuable mineral or minerals is or are collected in the froth which is generated on the surface of the flotation suspension, and this requires that their surfaces have previously been rendered hydrophobic by means of one or more collecting agents. The worthless minerals are then present in the flotation tailings. In inverse flotation, the worthless minerals are rendered hydrophobic by collecting agents, while the flotation tailings form the actual valuable concentrate. The present invention relates to the direct flotation of the phosphorus minerals, but it can also follow a preceding inverse flotation step which, for example, represents a flotation of silicate-type minerals by means of cationic collecting agents.

A large number of anionic and amphoteric chemical compounds are known as collecting agents for phosphorus minerals, and these include, for example, unsaturated fatty acids (oleic acid linoleic acid, linolenic acid) and the sodium, potassium or ammonium soaps thereof, monoalkyl and dialkyl phosphates, alkanesulfocarboxylic acids, alkylarylsulfonates, acylaminocarboxylic acids and alkylaminocarboxylic acids. In addition, collecting agents are known which are adducts of sulfosuccinic acid (see, for example U.S. Pat. Nos. 4,207,178, 4,192,739, 4,158,623 and 4,139,481 and Soviet Patent No. 1,113,317). Many of these classes of chemical compounds, however, suffer from unsatisfactory selectivity which does not allow the production of saleable phosphate concentrations or makes it necessary to use a relatively large quantity of regulating reagents, especially depressants for the gangue minerals.

In USSR Inventor's Certificate No. 1,084,076, collecting agents for phosphorus minerals, especially apatite, of the type of monoalkyl alkylsuccinates and alkenylsuccinates of the general formula $$\begin{array}{l} R^1-CH-CO-OH \\ \quad\;\; | \\ \quad\;\; CH_2-CO-OR^2 \end{array}$$

are described, where $R^1=R^2=C_7-C_{16}$-alkyl or $C_7-C_{16}$-alkenyl. These collecting agents are described as being particularly selective. In the flotation tests with carbonate- and silicate-containing apatite ores, reported as examples in this inventor's certificate, monoalkyl alkenylsuccinates with $R^1=C_8-C_{10}$-alkenyl and $R^2=C_7-C_{12}$-alkyl or $R^2=C_{10}-C_{16}$-alkyl were used.

In a further publication by W. A. Iwanowa and I. B. Bredermann: "Monoalkyl alkyl(alkenyl)succinates—effective collecting agents for apatite flotation" (from the book: A. M. Golman and I. L. Dimitrijewa (editors): Flotationsreagenzien [Flotation Reagents], published by "Nauka", Moscow, 1986; see also Chem. Abstr. 106 (14): 104652n), $R^1$ in the abovementioned formula is also restricted to $C_8-C_{12}$-alkenyl radicals or $C_{10}-C_{13}$-alkyl radicals, and the primary alcohols used for esterification are restricted to those with $R^2=C_7-C_{12}$-radicals.

In many laboratory flotation tests with various carbonate- and silicate-containing phosphate ores, it has now been found that not only the activity but also the selectivity of the monoalkyl alkenylsuccinates can be very significantly increased if alcohols with the shortest possible chain, i.e. methanol, ethanol, propanol and isopropanol, butanol, isobutanol and secondary butanol, are used for esterifying the alkenylsuccinic acid or alkenylsuccinic anhydride, and if olefins from the n- or iso-$C_8-C_{24}$ range are used as base products of the alkenylsuccinic anhydrides.

The invention thus relates to a process for selective flotation of phosphorus minerals, wherein a compound of the formula 1a or 1b $$\begin{array}{l} R^1-CH-COOM \\ \quad\;\; | \\ \quad\;\; CH_2-COOR^2 \end{array} \quad (1a) \text{ or } \begin{array}{l} R^1-CH-COOR^2 \\ \quad\;\; | \\ \quad\;\; CH_2-COOM \end{array} \quad (1b)$$

$$\begin{array}{l} R^1-CH-COOM \\ \quad\;\; | \\ \quad\;\; CH_2-COOR^2 \end{array} \quad (1a) \text{ or } \begin{array}{l} R^1-CH-COOR^2 \\ \quad\;\; | \\ \quad\;\; CH_2-COOM \end{array} \quad (1b)$$

in which $R^1$ is branched or unbranched $C_8-C_{24}$-alkenyl, $R^2$ is branched or unbranched $C_1-C_4$-alkyl and M is hydrogen, ammonium, triethanolammonium, an alkali metal atom or an alkaline earth metal atom, is added as a collecting agent to the flotation suspension.

These monoalkyl alkenylsuccinates are prepared in a known manner by reacting alkenylsuccinic anhydrides with $C_1$–$C_4$-alcohols in a 1:1 molar ratio. For complete reaction, either the mixture is heated for 5 hours to about 80°–120° C. or catalytic quantities of the corresponding alkoxide are added. In this case, the reaction has ended after one hour.

The abovementioned monoalkyl alkenylsuccinates are suitable for the flotation of all phosphorus minerals, such as apatite, phosphorite or francolite from crude ores or preconcentrates with carbonate minerals and/or silicate minerals as gangue, and from ores of magmatic as well as sedimentary or metamorphic genesis. These monoalkyl alkenylsuccinates are added to the flotation suspension, in particular in quantities of preferably 20 to 2000 and especially from 50 to 200 g per ton of crude ore or preconcentrate to be floated. This collecting agent can be added stepwise in several portions or all at once.

It is known to modify the flotation properties of anionic oxhydril collecting agents by secondary collecting agents or co-adsorbents in a positive direction. This relates in most cases not so much to the selectivity of the primary collecting agent but rather to the activity thereof, i.e. to the quantity thereof which is used, and to the regulation of the froth evolution. The combination with secondary collecting agents is also possible for the monoalkyl alkenylsuccinates to be used according to the invention. Such generally known substances include, for example, distilled or raw, preferably unsaturated fatty acid fractions. Nonionic substances can also be used, preferably those which are water-insoluble and have a polar character. Examples of suitable compounds are alcohols with n- or iso-alkyl chains, alkylene oxide adducts of alcohols, alkylphenols and fatty acids, fatty acid alkanolamides, sorbitan fatty acid esters, polyalkylene glycols, alkyl glycosides or alkenyl glycosides, saturated and unsaturated hydrocarbons, and the like. If such auxiliary reagents are used for flotation, the ratio of primary collecting agent relative to secondary collecting agent/co-adsorbent can vary within wide limits, for example from 10 to 90% by weight for the monoalkyl alkenylsuccinates and from 90 to 10% by weight for the secondary collecting agents and co-adsorbents. Usually, the quantity of active substance of the primary collecting agent is greater than that of the auxiliary reagents, but this does not exclude the converse relationships.

In most cases, the phosphorus minerals are rendered hydrophobic by the monoalkyl alkenylsuccinates so selectively that the other minerals present in the ore remain hydrophilic, i.e. are not collected in the froth on the surface of the flotation suspension. Depending on the mineral composition of the particular ore, however, it cannot be excluded that one or more depressants for the gangue minerals must be used in order to improve the success of the separation. Suitable inorganic-chemical or organic-chemical depressants are, for example, soda water glass, hydrofluoric acid (HF), sodium fluoride (NaF), sodium silicofluoride ($Na_2SiF_6$), hexametaphosphates or tripolyphosphates, ligninsulfonates as well as hydrophilic, relatively low-molecular polysaccharides such as starch (maize starch, rice starch and potato starch, alkali-digested), carboxymethylstarch, carboxymethylcellulose, sulfomethylcellulose, gum arabic, guar gums, substituted guar derivatives (for example carboxymethyl-, hydroxypropyl- and carboxymethyl-hyiroxypropyl-guars), tannins, alginates, phenol polymers (for example resol, novolak), phenol/formaldehyde copolymers, polyacrylates, polyacrylamides and the like.

As flotation frothing agents in the process according to the invention, all the products known for this purpose can be used, if necessary, such as, for example, terpene alcohols (pine oils), alkyl polyalkylene glycol ethers or polyalkylene glycols.

The pH value of the flotation suspension also plays a part in the froth flotation of phosphate ores. Usually, it is between 7 and 11, the flotation being carried out preferably at higher pH values from 9 to 11 in the case of apatite ores and preferably at lower pH values from 7 to 9 in the case of phosphorite ores. The optimum pH value of the flotation suspension, which can be decisive for the success of the flotation, differs from ore to ore and must be determined by laboratory and plant tests. Soda ($Na_2CO_3$), caustic soda (NaOH) or caustic potash (KOH) can be used for regulating the pH value.

In the examples which follow, the superiority of the collecting agents according to the invention is demonstrated by comparison with the collecting agents described in Soviet Patent No. 1,084,076. The following products were used.

Comparative products according to Soviet Patent No. 1,084,076:

| | | |
|---|---|---|
| collecting agent V1: | $iC_9$-alkenylsuccinic acid mono-$C_{8-10}$-ester | Na salt |
| collecting agent V2: | $iC_9$-alkenylsuccinic acid mono-$C_{12}$-ester | Na salt |
| collecting agent V3: | $nC_{12}$-alkenylsuccinic acid mono-$C_{12-18}$-ester | Na salt |

Products according to the present invention:

| | | |
|---|---|---|
| collecting agent H4: | $nC_{12}$-alkenylsuccinic acid mono-$iC_3H_7$-ester | |
| salt | | |
| collecting agent H5: | $C_{14-16}$-alkenylsuccinic acid mono-$iC_3H_7$-ester | Na salt |
| collecting agent H6: | $C_{16-18}$-alkenylsuccinic acid mono-$CH_3$-ester | Na salt |
| collecting agent H7: | $C_{16-18}$-alkenylsuccinic acid mono-$iC_3H_7$-ester | Na salt |
| collecting agent H8: | $C_{16-18}$-alkenylsuccinic acid mono-$iC_4H_9$-ester | Na salt |
| collecting agent H9: | $C_{18}$-alkenylsuccinic acid mono-$CH_3$-ester | Na salt |
| collecting agent H10: | $C_{18}$-alkenylsuccinic acid mono-$C_2H_5$-ester | Na salt |
| collecting agent H11: | $C_{18}$-alkenylsuccinic acid mono-$iC_3H_7$-ester | Na salt |
| collecting agent H12: | $C_{18}$-alkenylsuccinic acid mono-$iC_4H_9$-ester | Na salt |
| collecting agent H13: | $C_{18}$-alkenylsuccinic acid mono-$nC_{12}$-ester | Na salt |
| collecting agent H14: | $C_{16-18}$-alkenylsuccinic acid mono-$C_2H_5$-ester | Na salt |
| collecting agent H15: | sodium salt of a mixture of 30% by weight of collecting agent H5 70% by weight of distilled tall oil fatty acid with about 50% of oleic acid, about 37% of linoleic acid and about 1% of rosin acids | |

-continued

| | |
|---|---|
| collecting agent H16: | sodium salt of a mixture of<br>30% by weight of collecting agent H14<br>70% by weight of collecting agent D18 |
| collecting agent H17: | sodium salt of a mixture of<br>30% by weight of collecting agent H5<br>70% by weight of distilled tall oil fatty acid<br>(as contained in collecting agent H15) |

Other anionic oxhydril collecting agents for comparison:

Collecting agent D18: tall oil fatty acid, undistilled, with about 47% of fatty acids and about 37% of rosin acids; saponified with NaOH In all the following examples, about 400 g of natural phosphate ores in each case were floated, using a type D-12 laboratory flotation machine from Denver Equipment, U.S.A., with flotation cells of 2.5 l (rougher) and 1.0 l volume (cleaner).

The natural phosphate ores used for the tests can be characterized as follows.

Ore type A: $P_2O_5$ content about 12.8%, corresponding to about 30% by mass of apatite; gangue minerals: titanite, titanomagnetite, felspar, felspathoids (essentially nephelite), pyroxenes (essentially aegirite) and mica; ground to 80% by mass <110 μm.

Ore type B: $P_2O_5$ content about 15.3%, corresponding to about 36% by mass of apatite; gangue minerals and grinding as for ore type A.

Ore type C: $P_2O_5$ content about 9.0%, corresponding to about 21% by mass of apatite; gangue minerals: carbonate minerals (essentially calcite, a little dolomite), olivine (essentially forsterite), mica (essentially phlogopite); magnetite, which was largely removed by magnetic separation before flotation; grinding to 80% by mass <135 μm.

Ore type D: $P_2O_5$ content about 5.7%, corresponding to 13.5% by mass of apatite; gangue minerals: carbonate minerals (essentially calcite, a little dolomite), pyroxenes (for example augite), mica (essentially phlogopite), titanomagnetite; magnetite which was removed by magnetic separation before flotation; grinding to 80% by mass <270 μm.

EXAMPLE 1

Ore type A (average $P_2O_5$ content 12.8%), wet ground to Ore type A (average $P_2O_5$ content 12.8%), wet ground to 80% by weight less than 0.110 mm, was used for the flotation tests. Water of a total salinity of 690 mg/l the dissolved salts content of which had qualitatively and quantitatively the same composition as that obtained in the water of an industrial flotation plant, was added to the grinding and to the flotation. Each flotation test comprised the following steps:

Conditioning of the flotation suspension with 150 g/t of soda water glass as a dispersant for a time of 3 minutes; conditioning of the flotation suspension with the collecting agent, the added quantity of which was varied (see results), for a time of 3 minutes;

rougher flotation for a time of 2 minutes; three-fold cleaning (cleaner flotation) of the froth product (rougher concentrate) obtained in the rougher flotation, flotation time 2 minutes in each case.

The meanings of the symbols in the tables are: C=concentrate; F=feed; M1, M2 and M3=middlings; T=tailings.

In Example 1, the following flotation collecting agents are compared with one another: the collecting agents H9, H10, H11, H12 and H13 according to the invention are all based on a $C_{18}$-olefin; the comparative substance used was the collecting agent V3 (according to Soviet Patent No. 1,084,076).

The individual results of the flotation tests are listed in Table 1. Since the $P_2O_5$ contents of the end concentrates are within a narrow range, when the abovementioned collecting agents are used, namely between 38.3 and 39.2% (average value 39.0%), the $P_2O_5$ recovery values can be directly compared with one another.

The superiority of the collecting agents according to the invention is clear, because the quantities of the monoalkyl alkenylsuccinates with short ester groups $R^2$ required for use are only about 1/5 of those of the comparative substances with longer ester groups $R^2$ (collecting agents V3 and H13).

EXAMPLE 2

Ore type A (average $P_2O_5$ content 12.7%) and the collecting agents H5, H6, H7 and H8 were used for this example. The preparation and procedure of the flotation tests corresponded to those of Example 1. The individual results are recorded in Table 2.

In this example again, the $P_2O_5$ contents of the end concentrates (38.5 to 39.3%; average value 39.0%) are so close together that a direct comparison of the activity of the individual collecting agents is possible. Here again, the superiority of the substances according to the invention with short ester chains $R^2$ is demonstrated. As compared with the best collecting agent H6, at least five times the quantity of the comparative collecting agent V3 is required to obtain the same $P_2O_5$ recovery.

EXAMPLE 3

Ore type B which is similar to ore type A in a mineralogical respect but is somewhat richer in apatite (average $P_2O_5$ content 15.3%), was taken for the flotation tests. The preparation of this ore for flotation and the test procedure corresponded to those of Example 1. The collecting agent H7 according to the invention was compared with the three comparative products V1, V2 and V3. Table 3 contains the individual results.

In the flotation of this ore, the superiority of the collecting agent H7 according to the invention is found again. As shown by the $P_2O_5$ contents (see Table 3), however, the selectivity of the collecting agent H7, i.e. the obtainable apatite enrichment in the end concentrate as a function of the apatite recovery, is better than that of the comparative collecting agents. It is to be assumed that, at least for the comparative collecting agent V1, an additional fourth cleaning stage will be necessary to obtain the same concentrate quality, which would mean additional expense on flotation machines and energy consumption.

EXAMPLE 4

The purpose of the flotation tests in this example is to demonstrate the compatibility of the collecting agents according to the invention with different levels of salt contents in the flotation suspension.

Ore type B and its preparation for flotation correspond to those of Example 5. In contrast to Example 5, however, the total salinity of the liquid phase was increased from 690 to 1600 mg/l, which would result in operation with 100% recirculation of the process water without fresh water feed. In addition, to approach the plant conditions, two flotation tests were combined into a so-called closed-circuit test by including the middlings from the first test in the second test, i.e. the middlings 1 from the first test were added to the flotation feed of the second test, the middlings 2 were added to the feed of the first cleaning in the second test, and so on.

Furthermore, after the rougher flotation, a scavenger flotation stage with a further addition of collecting agent (30 g/t) was also carried out.

As shown by the following summary of the test results, the success of flotation is not substantially impaired when the collecting agent H14 according to the invention is used under otherwise identical test conditions.

| | | Total salinity | | | |
|---|---|---|---|---|---|
| | | 690 mg/l | | 1600 mg/l | |
| | | $P_2O_5$—Content (%) | $P_2O_5$—Recovery (%) | $P_2O_5$—Content (%) | $P_2O_5$—Recovery (%) |
| Collecting agent H14 | 2 × (90 + 30 g/t) | 39.9 | 69.0 | 39.9 | 67.5 |
| Collecting agent H14 | 2 × (110 + 30 g/t) | 39.9 | 79.1 | 40.0 | 77.0 |

Thus, the activity and selectivity of the collecting agents according to the invention is preserved even at very high salt contents of the flotation suspension. Complete recirculation of the process water is therefore possible without risk to the success of flotation, and this is important for protection of the environment.

EXAMPLE 5

Ore type C (average $P_2O_5$ content about 9.0%), which is characterized above all by high calcite and forsterite contents, was used for the flotation tests of this example. Small quantities of pyroxenes, phlogopite and dolomite are present. The presence of minerals having flotation properties very similar to those of apatite in this ore type inevitably leads to a reduction in selectivity, quite independently of the type of the collecting agent used. The magnetite content was largely removed by means of magnetic separation before the flotation. Grinding of the ore to 80% by mass $<135\ \mu m$ was carried out with desalinated water, which was also used in the further course of flotation. Deslurrying of the flotation feed did not take place. The pH value of the flotation suspension was regulated by means of soda (about 150 g/t; conditioning time 1 minute) to about 10.5–10.7. Soda water glass (about 700 g/t; conditioning time 3 minutes) was used as a dispersant and depressant. Subsequently, the collecting agent was added; conditioning time 3 minutes. Again as in the preceding examples, the rougher concentrate was cleaned three without further addition of reagents, so that three middlings were obtained in addition to the end concentrate and the wastes.

The individual results of the flotation tests are recorded in Table 4. The flotation of this ore type also clearly shows the high activity, i.e. the relatively small added quantities (g/t), of the collecting agent H7 according to the invention as compared with a collecting agent having a longer ester chain $R^2$, namely V3.

Admittedly, the selectivity of the comparative collecting agent V3, i.e. the $P_2O_5$ contents as a function of the respective $P_2O_5$ recovery values, is initially equivalent to the collecting agent H7 according to the invention; however, it then decreases very rapidly, and certainly more rapidly than that of the collecting agent H7 which ultimately reacts not only with a higher activity but indeed also with a higher selectivity.

The two collecting agent mixtures H15 and H16, which are combinations of monoalkyl alkenylsuccinates according to the invention with unsaturated fatty acid fractions of technical quality (e.g. collecting agent D18), were also included in Table 4. As can be seen, the flotation activity of the collecting agents according to the invention can be increased by admixing suitable fatty acids, even a synergistic effect appearing, since the recovery values of the collecting agent mixtures (H15, H16) are above those of the individual components (H7, D18). Regarding selectivity, the collecting agent mixtures H15 and H16 lead to averages between the individual components H7 and D18, i.e. these mixtures are not quite as selective as the monoalkyl alkenylsuccinates according to the invention but still clearly more selective than the comparative collecting agent V3. By shifting the mixing ratio of collecting agents according to the invention and secondary collecting agents in favor of the primary collecting agents, the selectivity can be improved. An increase in selectivity by two points is also possible, for example, by admixing 10% of a fatty acid alkoxylate, i.e. an anionic co-adsorbent such as the collecting agent H17 contains.

EXAMPLE 6

The flotation tests were carried out with ore type D which, on the one hand, has a comparatively low apatite content (5.7% of $P_2O_5$ corresponding to about 13.5% by mass of apatite) and, on the other hand, a very high calcite content of about 80%. Moreover, the grinding of the ore was relatively coarse: $D_{80}$=about 0.27 mm. The flotation was carried out with desalinated water. Initially, 500 g/t of starch, which had been digested with NaOH, were added to the flotation suspension (conditioning time 7 minutes), whereby the pH value of the flotation suspension was adjusted to about 10.5. By partial suppression of the calcite, the starch assists the selectivity of the course of flotation. This was followed by conditioning of the suspension with the particular collecting agent (time 3 minutes), the quantity of which was varied (see Table 5). The flotation then proceeded as usual: frothing out of a preconcentrate (flotation time 2.5 minutes), the final wastes remaining in the flotation cell; threefold cleaning of the preconcentrate (flotation time 2 minutes each), the end concentrate and three middlings being obtained. The individual results can be seen from Table 5. The collecting agents H6, H7, H8, H9, H10 and H14 according to the invention are compared with the comparative collecting agents V1 and V2. With this ore type again—under otherwise identical flotation conditions—the collecting agents according to the invention demonstrate their superiority with respect to both activity and selectivity. With an added quantity of 200 g/t, only 31.9% of $P_2O_5$ are recovered by the comparative collecting agent V1 (enrichment to 17.2% of $P_2O_5$), but not only $P_2O_5$ recovery values between 63.9 and 77.1%, but also enrichments to between 30.6 and 34.6% of $P_2O_5$ are achieved. The large quantities of comparative collecting agent V2 used are particularly conspicuous: a $P_2O_5$ recovery of only 57.2% is obtained with 1500 g/t. By contrast, only 300 g/t of the relatively weakest collecting agent H8 are required for approximately the same $P_2O_5$ recovery (59.5%). The selectivity of the two collecting agents is here about the same: V1 33.5 and H8 32.2% of $P_2O_5$ in the end concentrate.

TABLE 1

Ore type A

| Collecting agent | | % Recoveries by mass | | | | | % $P_2O_5$ Contents | | | | | | % $P_2O_5$ Recoveries | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| V3 | 200 | 12.0 | 2.6 | 4.3 | 10.7 | 70.4 | 12.5 | 39.1 | 36.3 | 34.6 | 24.1 | 4.0 | 37.5 | 7.7 | 11.8 | 20.5 | 22.5 |
| | 350 | 19.7 | 1.8 | 3.5 | 8.4 | 66.6 | 12.6 | 39.1 | 36.7 | 32.4 | 21.1 | 2.0 | 61.1 | 5.4 | 9.0 | 14.0 | 10.5 |
| | 500 | 22.7 | 1.5 | 3.1 | 9.6 | 63.1 | 12.5 | 39.1 | 35.4 | 30.2 | 13.4 | 1.4 | 70.9 | 4.1 | 7.6 | 10.3 | 7.1 |
| H9 | 70 | 14.2 | 3.4 | 4.3 | 9.2 | 68.9 | 13.0 | 39.1 | 37.4 | 36.3 | 25.3 | 3.3 | 42.5 | 9.8 | 12.2 | 18.0 | 17.5 |
| | 90 | 22.3 | 2.8 | 3.0 | 7.7 | 64.2 | 13.2 | 39.2 | 37.8 | 32.3 | 16.8 | 1.7 | 66.4 | 8.2 | 7.3 | 9.8 | 8.3 |
| | 110 | 26.2 | 1.8 | 2.5 | 6.4 | 63.1 | 13.0 | 39.2 | 35.9 | 26.6 | 10.7 | 1.1 | 79.3 | 4.9 | 5.2 | 5.3 | 5.3 |
| H10 | 90 | 20.1 | 2.9 | 3.4 | 8.2 | 65.4 | 12.7 | 38.9 | 37.7 | 33.9 | 16.9 | 1.9 | 61.5 | 8.7 | 9.1 | 10.9 | 9.8 |
| | 110 | 24.5 | 2.3 | 2.7 | 6.8 | 63.7 | 12.7 | 38.3 | 36.8 | 30.5 | 11.9 | 1.3 | 73.8 | 6.8 | 6.5 | 6.4 | 6.5 |
| | 130 | 26.4 | 1.6 | 2.1 | 6.9 | 63.0 | 12.7 | 38.8 | 35.8 | 26.8 | 9.5 | 1.1 | 80.4 | 4.5 | 4.5 | 5.2 | 5.4 |
| H11 | 110 | 15.0 | 3.5 | 5.0 | 10.1 | 66.4 | 12.9 | 39.0 | 38.2 | 35.6 | 22.3 | 2.5 | 45.4 | 10.4 | 13.9 | 17.4 | 12.9 |
| | 130 | 19.2 | 3.0 | 3.9 | 8.0 | 65.9 | 12.7 | 39.2 | 38.0 | 34.8 | 19.8 | 1.7 | 59.2 | 8.9 | 10.7 | 12.4 | 8.8 |
| | 150 | 21.2 | 2.5 | 3.5 | 8.5 | 64.3 | 12.6 | 39.0 | 37.1 | 32.9 | 16.7 | 1.3 | 65.5 | 7.4 | 9.2 | 11.3 | 6.6 |
| H12 | 150 | 11.0 | 3.3 | 5.1 | 10.5 | 70.1 | 12.4 | 39.2 | 37.6 | 35.9 | 24.5 | 3.5 | 34.7 | 10.0 | 14.9 | 20.7 | 19.7 |
| | 200 | 16.4 | 3.4 | 4.3 | 9.9 | 66.0 | 12.7 | 38.7 | 37.7 | 35.2 | 20.4 | 2.3 | 49.9 | 10.2 | 12.0 | 15.9 | 12.0 |
| | 250 | 19.6 | 3.2 | 4.2 | 9.2 | 63.8 | 12.6 | 38.5 | 37.5 | 30.7 | 16.4 | 1.6 | 60.1 | 9.5 | 10.3 | 12.0 | 8.1 |
| H13 | 350 | 22.3 | 2.3 | 3.6 | 8.7 | 63.1 | 13.0 | 38.9 | 35.7 | 29.7 | 16.7 | 1.5 | 67.0 | 6.3 | 8.2 | 11.2 | 7.3 |
| | 500 | 24.3 | 2.2 | 3.8 | 9.6 | 60.1 | 12.8 | 38.6 | 32.8 | 25.5 | 11.7 | 1.0 | 73.2 | 5.7 | 7.7 | 8.7 | 4.7 |

TABLE 2

Ore type A

| Collecting agent | | % Recoveries by mass | | | | | % $P_2O_5$ Contents | | | | | | % $P_2O_5$ Recoveries | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| V3 | 200 | 12.0 | 2.6 | 4.3 | 10.7 | 70.4 | 12.5 | 39.1 | 36.3 | 34.6 | 24.1 | 4.0 | 37.5 | 7.7 | 11.8 | 20.5 | 22.5 |
| | 350 | 19.7 | 1.8 | 3.5 | 8.4 | 66.6 | 12.6 | 39.1 | 36.7 | 32.4 | 21.1 | 2.0 | 61.1 | 5.4 | 9.0 | 14.0 | 10.5 |
| | 500 | 22.7 | 1.5 | 3.1 | 9.6 | 63.1 | 12.5 | 39.1 | 35.4 | 30.2 | 13.4 | 1.4 | 70.9 | 4.1 | 7.6 | 10.3 | 7.1 |
| H6 | 50 | 10.4 | 3.0 | 4.5 | 10.6 | 71.5 | 12.7 | 39.2 | 38.5 | 35.5 | 25.2 | 4.5 | 32.2 | 9.0 | 12.6 | 20.9 | 25.3 |
| | 70 | 21.7 | 2.8 | 3.2 | 8.0 | 64.3 | 13.1 | 39.3 | 37.9 | 33.3 | 16.4 | 1.7 | 65.3 | 8.1 | 8.1 | 10.1 | 8.4 |
| | 90 | 25.9 | 2.0 | 2.2 | 6.5 | 63.4 | 12.7 | 38.9 | 35.7 | 27.5 | 10.3 | 1.0 | 79.4 | 5.5 | 4.8 | 5.3 | 5.0 |
| H7 | 70 | 18.6 | 3.9 | 3.6 | 8.7 | 65.2 | 12.7 | 39.1 | 38.2 | 33.9 | 17.9 | 1.8 | 57.3 | 11.6 | 9.7 | 12.2 | 9.2 |
| | 90 | 24.4 | 2.3 | 2.6 | 7.1 | 63.6 | 12.7 | 39.1 | 36.7 | 30.3 | 12.5 | 1.0 | 75.1 | 6.6 | 6.3 | 7.0 | 5.0 |
| | 110 | 28.0 | 1.4 | 2.0 | 7.4 | 61.2 | 12.8 | 38.5 | 34.6 | 24.2 | 7.8 | 0.8 | 84.2 | 3.7 | 3.8 | 4.5 | 3.8 |
| H8 | 150 | 16.8 | 3.4 | 4.8 | 9.6 | 65.4 | 12.7 | 39.2 | 38.2 | 35.0 | 20.9 | 1.8 | 51.6 | 10.2 | 13.2 | 15.8 | 9.2 |
| | 200 | 21.5 | 2.5 | 3.6 | 7.8 | 64.6 | 12.5 | 38.9 | 37.5 | 32.9 | 15.6 | 1.2 | 67.0 | 7.4 | 9.6 | 9.8 | 6.2 |
| | 250 | 24.8 | 2.1 | 2.7 | 7.8 | 62.6 | 12.4 | 38.6 | 35.1 | 28.3 | 10.8 | 0.8 | 77.0 | 6.1 | 6.1 | 6.8 | 4.0 |
| H5 | 90 | 9.3 | 6.6 | 9.0 | 12.9 | 62.2 | 13.0 | 38.7 | 38.7 | 35.5 | 20.9 | 1.6 | 27.6 | 19.6 | 24.4 | 20.7 | 7.7 |
| | 110 | 21.4 | 3.6 | 4.7 | 10.5 | 59.8 | 13.4 | 38.8 | 36.4 | 30.0 | 17.9 | 0.8 | 62.0 | 9.8 | 10.5 | 14.1 | 3.6 |

with the collecting agents according to the invention,

TABLE 3

Ore type B

| Collecting agent | | % Recoveries by mass | | | | | % $P_2O_5$ Contents | | | | | | % $P_2O_5$ Recoveries | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| V1 | 200 | 3.8 | 7.4 | 12.1 | 20.1 | 56.6 | 15.2 | 39.0 | 36.7 | 34.4 | 25.7 | 3.0 | 9.6 | 17.8 | 27.5 | 34.0 | 11.1 |
| | 300 | 13.8 | 6.8 | 12.1 | 16.0 | 51.3 | 15.4 | 38.7 | 35.7 | 30.5 | 18.9 | 1.8 | 34.6 | 15.8 | 23.9 | 19.7 | 6.0 |
| | 400 | 19.5 | 6.4 | 9.9 | 14.6 | 49.6 | 15.4 | 38.4 | 33.5 | 27.9 | 16.1 | 1.4 | 48.5 | 14.0 | 17.8 | 15.2 | 4.5 |
| V2 | 750 | 15.7 | 6.2 | 9.0 | 15.0 | 54.1 | 15.5 | 39.6 | 37.7 | 32.6 | 20.0 | 1.8 | 40.2 | 15.2 | 18.9 | 19.4 | 6.3 |
| | 1000 | 21.9 | 5.2 | 7.5 | 13.3 | 52.1 | 15.3 | 39.5 | 36.2 | 29.7 | 14.9 | 1.0 | 56.8 | 12.2 | 14.6 | 13.0 | 3.4 |
| | 1250 | 25.8 | 3.9 | 5.9 | 10.1 | 54.3 | 15.2 | 39.3 | 35.8 | 30.0 | 15.2 | 0.7 | 66.6 | 9.2 | 11.6 | 10.1 | 2.5 |
| V3 | 300 | 14.1 | 4.7 | 6.1 | 11.5 | 63.6 | 15.1 | 39.7 | 39.0 | 35.4 | 25.7 | 4.0 | 37.1 | 12.2 | 14.3 | 19.6 | 16.8 |
| | 400 | 20.7 | 4.3 | 5.4 | 11.5 | 58.1 | 15.2 | 39.6 | 36.7 | 31.1 | 18.9 | 2.7 | 53.9 | 10.4 | 11.1 | 14.3 | 10.3 |
| | 400 | 23.2 | 3.5 | 5.4 | 11.0 | 56.8 | 15.1 | 39.4 | 34.0 | 30.9 | 17.1 | 2.1 | 60.8 | 7.8 | 11.0 | 12.5 | 7.9 |
| H7 | 70 | 14.6 | 4.9 | 8.1 | 11.8 | 57.6 | 15.2 | 39.7 | 37.4 | 32.2 | 19.8 | 3.5 | 38.1 | 12.1 | 17.2 | 19.3 | 13.3 |
| | 90 | 23.2 | 4.1 | 6.5 | 13.0 | 53.2 | 15.4 | 39.6 | 36.0 | 28.6 | 13.9 | 2.0 | 59.6 | 9.6 | 12.1 | 11.8 | 6.9 |
| | 110 | 27.9 | 3.5 | 5.0 | 11.7 | 51.9 | 15.3 | 39.5 | 34.8 | 25.1 | 9.4 | 1.4 | 71.9 | 8.0 | 8.2 | 7.2 | 4.7 |

TABLE 4

| Collecting agent | | % Recoveries by mass | | | | | % $P_2O_5$ Contents | | | | | | % $P_2O_5$ Recoveries | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| V3 | 500 | 11.2 | 2.7 | 6.4 | 15.5 | 64.2 | 9.0 | 38.1 | 26.4 | 18.1 | 7.7 | 2.6 | 47.5 | 7.9 | 12.8 | 13.3 | 18.5 |
| | 700 | 13.2 | 4.2 | 9.6 | 18.1 | 54.9 | 8.9 | 36.2 | 21.0 | 11.4 | 5.0 | 2.2 | 54.0 | 10.0 | 12.2 | 10.2 | 13.6 |
| | 900 | 17.8 | 7.1 | 13.4 | 21.5 | 40.2 | 9.0 | 31.1 | 12.0 | 7.7 | 4.1 | 1.8 | 61.4 | 9.4 | 11.4 | 9.8 | 8.0 |
| H7 | 100 | 7.5 | 6.8 | 11.9 | 13.5 | 60.3 | 9.1 | 38.0 | 32.0 | 15.1 | 7.0 | 2.2 | 31.3 | 23.9 | 19.8 | 10.4 | 14.6 |
| | 125 | 17.5 | 5.4 | 6.9 | 10.5 | 59.7 | 9.1 | 34.2 | 14.5 | 9.4 | 6.1 | 1.7 | 65.9 | 8.6 | 7.2 | 7.1 | 11.2 |
| | 150 | 19.8 | 5.7 | 7.5 | 12.4 | 54.6 | 8.7 | 32.0 | 11.7 | 6.4 | 4.0 | 1.3 | 73.0 | 7.7 | 5.5 | 5.7 | 8.1 |
| H15 | 60 | 7.5 | 9.4 | 10.7 | 13.3 | 59.1 | 8.9 | 35.9 | 25.2 | 13.5 | 6.9 | 2.5 | 30.4 | 26.7 | 16.1 | 10.2 | 16.6 |
| | 80 | 19.1 | 10.0 | 9.9 | 13.4 | 47.6 | 8.8 | 29.4 | 11.6 | 6.4 | 4.4 | 1.7 | 63.7 | 13.2 | 7.2 | 6.7 | 9.2 |
| | 100 | 29.9 | 8.9 | 9.5 | 12.4 | 39.3 | 8.9 | 22.8 | 6.6 | 4.9 | 3.6 | 1.4 | 76.9 | 6.6 | 5.3 | 5.0 | 6.2 |
| H16 | 80 | 9.2 | 8.0 | 8.9 | 13.6 | 60.3 | 9.3 | 33.4 | 21.5 | 14.0 | 9.2 | 3.3 | 33.0 | 18.6 | 13.4 | 13.5 | 21.5 |
| | 100 | 17.2 | 7.8 | 9.7 | 13.5 | 51.8 | 9.3 | 29.3 | 13.6 | 9.4 | 7.6 | 2.4 | 54.4 | 11.3 | 9.8 | 11.1 | 13.4 |
| | 120 | 26.8 | 8.2 | 9.4 | 13.6 | 42.0 | 9.1 | 24.1 | 9.5 | 5.5 | 4.3 | 1.9 | 70.7 | 8.5 | 5.7 | 6.4 | 8.7 |
| H17 | 100 | 24.4 | 9.9 | 9.6 | 11.9 | 44.2 | 8.8 | 27.5 | 7.7 | 4.5 | 3.2 | 1.2 | 76.2 | 8.6 | 4.9 | 4.3 | 6.0 |
| D18 | 100 | 14.9 | 7.8 | 7.9 | 12.6 | 56.8 | 9.0 | 25.0 | 16.8 | 11.9 | 8.4 | 3.5 | 41.3 | 14.5 | 10.4 | 11.7 | 22.1 |
| | 125 | 21.0 | 8.7 | 8.5 | 14.9 | 46.9 | 9.0 | 22.0 | 12.8 | 9.5 | 7.2 | 3.0 | 51.1 | 12.4 | 9.0 | 11.9 | 15.6 |
| | 150 | 27.7 | 8.7 | 9.3 | 15.1 | 39.2 | 8.9 | 19.0 | 10.1 | 8.8 | 5.9 | 2.6 | 59.4 | 9.9 | 9.2 | 10.0 | 11.5 |

TABLE 5

| Collecting agent | | % Recoveries by mass | | | | | % $P_2O_5$ Contents | | | | | | % $P_2O_5$ Recoveries | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| V1 | 150 | 4.0 | 5.2 | 6.3 | 9.5 | 75.0 | 5.9 | 21.9 | 14.9 | 12.1 | 10.4 | 3.3 | 15.0 | 13.3 | 12.9 | 16.7 | 42.1 |
| | 175 | 8.8 | 4.8 | 6.1 | 9.2 | 71.1 | 5.8 | 17.8 | 11.8 | 10.4 | 10.5 | 2.9 | 27.1 | 9.8 | 10.9 | 16.7 | 35.5 |
| | 200 | 10.9 | 5.0 | 6.3 | 9.1 | 68.7 | 5.9 | 17.2 | 10.9 | 10.7 | 9.7 | 2.8 | 31.9 | 9.3 | 11.3 | 14.9 | 32.6 |
| V2 | 1000 | 4.0 | 3.4 | 6.5 | 14.4 | 71.7 | 5.5 | 36.2 | 21.0 | 13.1 | 8.3 | 1.8 | 26.3 | 13.3 | 15.3 | 21.7 | 23.4 |
| | 1250 | 7.3 | 4.3 | 7.2 | 14.8 | 66.4 | 5.7 | 35.9 | 18.3 | 9.2 | 5.4 | 1.3 | 45.5 | 13.9 | 11.5 | 14.0 | 15.1 |
| | 1500 | 9.5 | 4.8 | 8.7 | 14.7 | 62.3 | 5.6 | 33.5 | 12.7 | 6.8 | 3.7 | 1.0 | 57.2 | 11.1 | 10.7 | 9.8 | 11.2 |
| H6 | 150 | 9.5 | 2.0 | 3.8 | 7.9 | 76.8 | 5.6 | 35.7 | 12.0 | 7.5 | 5.9 | 1.6 | 60.3 | 4.2 | 5.2 | 8.4 | 21.9 |
| | 200 | 13.6 | 2.6 | 4.7 | 9.2 | 69.9 | 5.6 | 31.7 | 5.9 | 4.3 | 3.2 | 0.9 | 77.1 | 2.7 | 3.6 | 5.3 | 11.3 |
| | 250 | 17.1 | 3.6 | 6.0 | 10.7 | 62.6 | 5.7 | 27.7 | 3.4 | 2.9 | 2.0 | 0.7 | 83.3 | 2.2 | 3.0 | 3.8 | 7.7 |
| H14 | 150 | 7.8 | 2.0 | 3.7 | 7.5 | 79.0 | 5.6 | 36.4 | 16.3 | 9.6 | 7.3 | 2.0 | 50.3 | 5.6 | 6.4 | 9.7 | 28.0 |
| | 200 | 12.1 | 2.4 | 4.4 | 9.1 | 72.0 | 5.7 | 33.3 | 8.5 | 5.9 | 4.1 | 1.1 | 71.3 | 3.5 | 4.6 | 6.6 | 14.0 |
| | 250 | 16.0 | 3.3 | 5.1 | 10.4 | 65.2 | 5.8 | 29.5 | 4.3 | 3.5 | 2.6 | 0.8 | 80.9 | 2.4 | 3.1 | 4.6 | 9.0 |
| H7 | 150 | 8.7 | 2.2 | 3.9 | 7.8 | 77.4 | 5.6 | 34.8 | 13.8 | 9.1 | 6.4 | 1.8 | 54.2 | 5.5 | 6.4 | 8.9 | 25.0 |
| | 200 | 13.2 | 2.9 | 4.8 | 7.8 | 71.3 | 5.7 | 30.6 | 7.3 | 6.1 | 4.0 | 1.2 | 70.7 | 3.7 | 5.2 | 5.4 | 15.0 |
| | 250 | 18.5 | 3.7 | 5.2 | 8.0 | 64.6 | 5.7 | 24.6 | 4.6 | 3.2 | 2.6 | 0.9 | 80.1 | 3.0 | 2.9 | 3.7 | 10.3 |
| H8 | 300 | 10.4 | 3.4 | 5.3 | 9.2 | 71.7 | 5.6 | 32.2 | 13.7 | 7.7 | 5.0 | 1.3 | 59.5 | 8.4 | 7.3 | 8.2 | 16.6 |
| | 350 | 12.4 | 3.7 | 5.9 | 9.7 | 68.3 | 5.7 | 30.8 | 10.4 | 6.4 | 3.8 | 1.1 | 66.9 | 6.8 | 6.6 | 6.5 | 13.2 |
| | 400 | 15.9 | 4.6 | 7.1 | 12.0 | 60.4 | 5.8 | 27.7 | 6.4 | 4.0 | 2.4 | 0.9 | 75.7 | 5.0 | 4.9 | 5.0 | 9.4 |
| H9 | 150 | 10.5 | 1.5 | 3.2 | 6.8 | 78.0 | 5.9 | 34.5 | 13.4 | 10.0 | 8.0 | 1.5 | 61.9 | 3.5 | 5.5 | 9.2 | 19.9 |
| | 200 | 11.7 | 2.0 | 4.0 | 8.0 | 74.3 | 5.5 | 34.1 | 5.7 | 4.9 | 3.8 | 1.2 | 72.6 | 2.1 | 3.5 | 5.6 | 16.2 |
| | 250 | 14.6 | 2.8 | 5.2 | 10.8 | 66.6 | 5.6 | 30.3 | 5.7 | 3.9 | 2.6 | 0.8 | 79.0 | 2.9 | 3.6 | 5.0 | 9.5 |
| H10 | 150 | 6.2 | 1.7 | 3.3 | 6.5 | 82.3 | 5.5 | 35.8 | 13.8 | 9.5 | 7.1 | 2.8 | 40.2 | 4.2 | 5.6 | 8.4 | 41.6 |
| | 200 | 10.4 | 2.0 | 3.8 | 7.7 | 76.1 | 5.6 | 34.6 | 10.6 | 7.5 | 5.0 | 1.5 | 63.9 | 3.7 | 5.1 | 6.9 | 20.4 |
| | 250 | 13.3 | 2.6 | 5.2 | 10.0 | 68.9 | 5.5 | 31.6 | 6.7 | 4.4 | 2.9 | 0.9 | 76.2 | 3.2 | 4.2 | 5.2 | 11.2 |

We claim:

1. A process for selective flotation of phosphorus minerals from magmatic, sedimentary or metamorphic ore deposits containing said phosphorous minerals and gangue minerals, which comprises subjecting an ore suspension containing said phosphorous minerals to flotation in the presence of a sufficient amount of a compound of the formula 1a or 1b

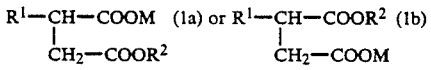

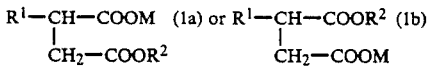

in which $R^1$ is branched or unbranched $C_8$–$C_{24}$-alkenyl, $R^2$ is branched or unbranched $C_1$–$C_4$-alkyl and M is hydrogen, ammonium, triethanolammonium, an alkali metal atom or an alkaline earth metal atom, to act as a selective collecting agent for said phosphorous minerals.

2. The process as claimed in claim 1, wherein a compound of the formula 1a or 1b is present, in which $R^1$ is branched or unbranched $C_{12}$–$C_{18}$-alkenyl and $R^2$ is branched or unbranched $C_1$–$C_4$-alkyl.

3. The process as claimed in claim 1, wherein the phosphorus minerals containing ore which is subjected to flotation contains carbonate minerals and/or silicate minerals as said gangue minerals.

4. The process as claimed in claim 1, wherein the ore suspension during flotation has a pH value from 7 to 11.

5. The process as claimed in claim 1, wherein the compounds of the formula 1a and 1b are used together with other collecting agents.

6. The process as claimed in claim 1, wherein the compounds of the formulae 1a and 1b are used together with nonionic co-adsorbents.

7. The process as claimed in claim 1, wherein the compounds of the formulae 1a and 1b are used together with conventional flotation frothing agents.

8. The process as claimed in claim 1, wherein the compounds of the formulae 1a and 1b are used together with conventional depressants for the gangue minerals.

9. The process as claimed in claim 1, wherein the compound of the formula 1a or 1b is present in a quantity from 20 to 2000 g per ton of ore in the ore suspension.

10. The process as claimed in claim 1, wherein the compound of the formula 1a or 1b is present in a quantity from 50 to 200 g per ton of ore in the ore suspension.

* * * * *